US006543558B1

(12) United States Patent
Hauptmann et al.

(10) Patent No.: US 6,543,558 B1
(45) Date of Patent: Apr. 8, 2003

(54) DRILLING AND/OR CHISELING TOOL

(75) Inventors: Udo Hauptmann, Landsberg/Lech (DE); Martin Richter, Freising (DE); Konrad Artmann, Wörthsee (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/696,375

(22) Filed: Oct. 25, 2000

(30) Foreign Application Priority Data

Oct. 29, 1999 (DE) ..... 199 52 225

(51) Int. Cl.[7] ..... E21B 10/36
(52) U.S. Cl. ..... 175/320; 175/414; 175/415
(58) Field of Search ..... 175/320, 414, 175/415; 279/2.23

(56) References Cited

U.S. PATENT DOCUMENTS 2,479,698 A * 8/1949 Paquin ..... 173/133
4,749,051 A * 6/1988 Larsson ..... 175/320
5,324,145 A * 6/1994 Kleine ..... 279/19.3
5,820,312 A * 10/1998 Stock et al. ..... 173/205
5,984,596 A * 11/1999 Fehrle et al. ..... 175/395
6,253,864 B1 * 7/2001 Hall ..... 175/414

FOREIGN PATENT DOCUMENTS

WO WO 8704487 A1 * 7/1987 ..... E21B/17/042

* cited by examiner

*Primary Examiner*—David Bagnell
*Assistant Examiner*—Daniel P Stephenson
(74) *Attorney, Agent, or Firm*—Sidley Austin Brown & Wood, LLP

(57) ABSTRACT

A drilling and/or chiseling tool (1) comprises a shaft (2) and a cylindrical insertion end (4) connected with the shaft (2) with at least one elongated recess (5 to 8), open toward the outer surface of and toward the free end of the insertion end (9) and forming a rotationally locking groove. A collar (3) is disposed between the shaft (2) and the insertion end (4) and extends at least partially around the tool (1) and projects at least radially outwardly of the shaft (2) and of the insertion end (4). The cylindrical insertion end (4)has a diameter not less than 18 mm and preferably larger than 22 mm. The at least one recess (5 to 8) has a cross-sectional area, extending perpendicularly to the axis of the tool (1), and expands toward the outer surface and is provided essentially in the form of an arc of a circle. A tool chuck of a drilling and/or chiseling device, matched to the insertion end, is provided to receive the insertion end (4) of the tool (1) and fit rotationally locking bodies into the at least one elongated recess (5to 8).

11 Claims, 2 Drawing Sheets

DRILLING AND/OR CHISELING TOOL

FIELD OF INVENTION

The invention relates to a drilling and/or chiseling tool with a shaft having a cylindrical insertion and with at least one elongated recess open on the outer surface and free end of the insertion end. A collar is located on the shaft extending at least partially around and radially outwardly of the shaft and insertion end. The invention also relates to a tool chuck or holder of the device for a tool, constructed in accordance with the invention.

BACKGROUND INFORMATION AND PRIOR ART

Drilling and/or chiseling devices, which have a pneumatic or a hydraulic drive are generally used to produce deep boreholes in rock. The drilling and/or chiseling tools, which are used in connection with these devices, have, for example, a hexagonally shaped insertion end for a correspondingly shaped tool chuck of the drilling and/or chiseling device. Tools are also known that have an insertion end with a plurality of oblong grooves. The grooves have an approximately trapezoidal cross-section and interact, in the tool chuck of the drilling and/or chiseling device, with strip-shaped rotationally locking bodies, which extend axially and are formed on the inner wall of the tool chuck. The axial locking of these known drilling and/or chiseling tools is accomplished by means of a shackle affixed to the device, which can be pivoted and engages a collar or the like provided on the drilling and/or chiseling tool.

For the production of deep boreholes in rock, the drilling and/or chiseling tools are subjected to high torques, which lead to increased wear, particularly in the region of the rotationally locking grooves or rotationally locking surfaces of the tool and the rotational catches of the tool chuck or holder of the drilling and/or chiseling device. The wear is increased further by the abrasive products formed during drilling and/or chiseling.

SUMMARY OF THE INVENTION

Therefore, it is the object of the present invention to eliminate these disadvantages in the state of the art and to create a drilling and/or chiseling tool with an improved service life. In this connection, the drilling and/or chiseling tool is also intended to be used in conjunction with electrically operated drilling and/or chiseling devices with an electropneumatic striking mechanism. Furthermore, for a drilling and/or chiseling device, a tool chuck or holder, which exhibits less susceptibility to wear, is to be developed.

These tasks are accomplished with a drilling and/or chiseling tool where the insertion end of the tool has a diameter of at least 18 mm and the recess in the insertion end has the form of a divided or partial circle. Advantageous variations of the invention and/or preferred examples are set forth in the dependent claims. A tool chuck or holder of a drilling and/or chiseling device, matched to the inventive drilling and/or chiseling tool, is also set forth in the dependent claims. The inventive drilling and/or chiseling tool comprises a shaft with a cylindrical insertion end having at least one axially elongated recess, which is open towards the outer surface and towards the free end of the insertion end. A collar is disposed between the shaft and the insertion end and extends at least partially around the tool and projects radially outwardly, at least partially beyond the shaft and the insertion end. The cylindrical insertion end has a diameter, which is equal to or larger than 18 mm and preferably larger than 22 mm. The at least one recess has a cross-sectional area, which extends perpendicularly to the center axis of the tool, which expands towards the outer surface of the insertion end and has the form of a divided circle or arc of a circle.

For the given large diameters of the insertion end, the drilling and/or chiseling tools of the state of the art usually have an insertion end, which is constructed as a hexagon and, at the transition to the shaft, have a revolving annular collar. On the other hand, the inventive drilling and/or chiseling tool starts out from an insertion end, which is essentially cylindrical and has at least one recess, which extends in the axial direction and is open towards the free end and towards the periphery. For reasons of symmetry and for a better introduction of force, the at least one recess has a cross-section surface perpendicular to the center axis and is essentially formed in the shape of an arc. The at least one recess serves as a rotationally locking groove. In connection with a correspondingly formed rotationally locking body in a tool chuck or holder of a drilling and/or chiseling device, the rotationally locking groove, which is present as a round groove, because of its cross-sectional shape, demonstrates less wear during the transfer of torque than do the insertion ends of the tools in the state of the art. The open structure of the round groove towards the free end of the insertion end facilitates the accurate positioning of the tool during insertion. In particular, the inventive drilling and/or chiseling tool is also prepared for use in connection with electrically operated drilling and/or chiseling devices, which demonstrate the advantageous electropneumatic striking mechanism technology and the proven drive technology of the hammer drilling devices, which are known from the state of the art and are designed for tools with insertion ends up to 18 mm and are also sold by the assignee.

In an advantageous embodiment of the invention, the recess has a radius of curvature that corresponds approximately to 0.1 to 0.35 times the diameter of the insertion end. In connection with the minimum diameter for the insertion end as indicated, the selected range for the radius of curvature of the recess formed as a rounded groove, in connection with a correspondingly shaped rotationally locking body, results in two-dimensional contact, which has an advantageous effect on the wear of the recess and/or the rotationally locking body.

In order to be able to transfer sufficiently great torques, a depth of the recess, measured in the radial direction, with reference to the outer surface amounts to approximately 50% to 100% of the radius of curvature of the recess formed as-a rounded groove, proves to be advantageous.

In a particularly practical embodiment of the inventive drilling and/or chiseling tool, the insertion end has four recesses that are arranged evenly around the circumference of the insertion end. The larger number of recesses allows the transfer of greater torques. Because of the uniform arrangement of the identically formed recesses around the circumference of the cylindrical insertion end, the tool can be inserted in four positions and only has to be rotated for a small angle, a maximum angle of approximately 90°, when being inserted into a correspondingly formed tool holder, so that the rotationally locking body or bodies can enter into the recess(es).

To ensure that, in operation, the correspondingly formed rotationally locking bodies, over their whole axial length, if possible and in every axial portion of the tool, are in two-dimensional engagement with the recesses, the locking bodies in each case advantageously have a length, which corresponds to about 2 times to about 4 times the diameter of the insertion end.

The drilling and/or chiseling tool is axially secured by means of a pivotable shackle or the like, that engages the collar in the transition region from the shaft to the insertion end. To guarantee a secure axial hold for the tool even during hard use, and so that the tool does not unintentionally fall out of the tool holder as a result of the axial impacts applied to the rear, free end of the insertion end, the outer diameter of the collar is about 1.25 times to about 1.5 times the diameter of the insertion end.

The length of the insertion end is defined by the distance of the collar from the free end of the insertion end. To create a sufficiently long length for the axial recesses, a distance of the collar from the free end of the insertion end, which amounts to about 7 times to about 9 times the diameter of the insertion end, proves to be advantageous.

A tool chuck or holder of a drilling and/or chiseling device for operation along with an inventive drilling and/or chiseling tool comprises a tool chuck with at least one roller-shaped rotationally locking body. The latter is fixed radially and axially in a groove provided in the inner wall of the tool chuck. In this connection, the groove is constructed in such a way that the at least one roller-shaped rotationally locking body can be rotated about its axis in the groove. Because of the rotatable mounting of the rotationally locking body, the entire surface of the rotationally locking body engages with the recess in the insertion end of the tool. By these means, wear phenomena are distributed over the entire surface of the rotationally locking body and its service life is extended. Advantageously, the rotationally locking body is selected so that about 30% to 47% of its largest diameter protrudes from the inner wall of the tool chuck.

In order to achieve particularly good two-dimensional contact of the at least one rotationally locking body in the recess in the insertion end of the drilling and/or chiseling tool, the radius of curvature of the at least one rotationally locking body corresponds to the radius of curvature of the recess in the insertion end.

For uniformly stressing the recesses in the insertion end of the inventive drilling and/or chiseling tool, and for transferring large torques, it is advantageous if the number of rotationally locking bodies in the tool holder advantageously corresponds to the number of recesses in the insertion end of the drilling and/or chiseling tool. In this connection, it is preferably if the rotationally locking bodies are distributed uniformly around the periphery of the inner wall of the tool chuck. For reasons of space and simple symmetry, four rotationally locking bodies, are provided.

So that every rotationally locking body remains in contact in all positions of the tool with every corresponding recess in the insertion end of the tool over as large an area as possible during operation of the drilling and/or chiseling device, an axial length for each rotationally locking body amounting to about 25% to about 70% of the axial length of a recess in the insertion end of the drilling and/or chiseling tool proves to be advantageous.

Very simple maintenance and replacement of the tool holder and, in particular, of the rotationally locking body are guaranteed owing to the fact that the rotationally locking bodies are fixed radially by a removable fixing sleeve, which can be placed on the outside of the tool chuck, facing away from the inner wall.

The invention will be explained in greater detail below, with reference to an example shown in the Figures, in the diagrammatic representation, which is not to scale.

DETAILED DESCRIPTION OF THE INVENTION

Figure 1:
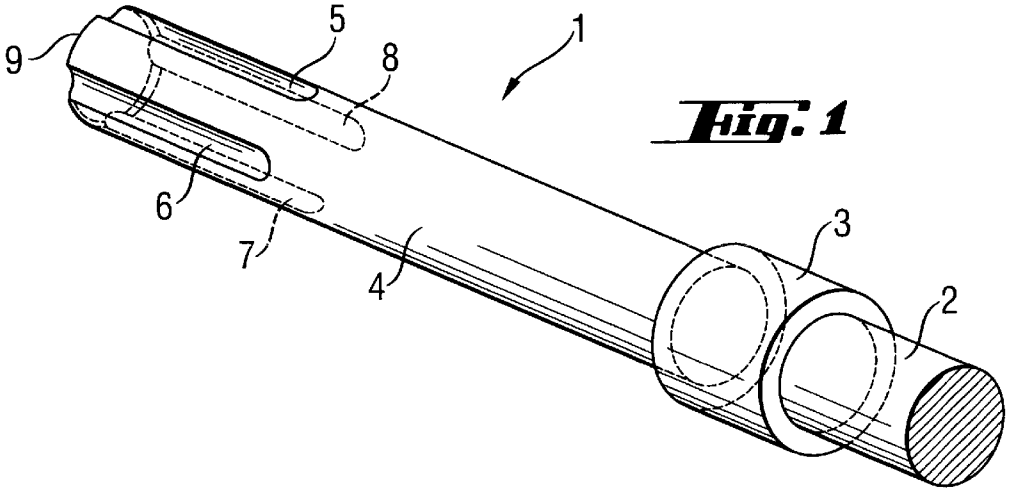
FIG. 1 is a perspective view of an insertion end of an inventive drilling and/or chiseling tool.
Figure 3:
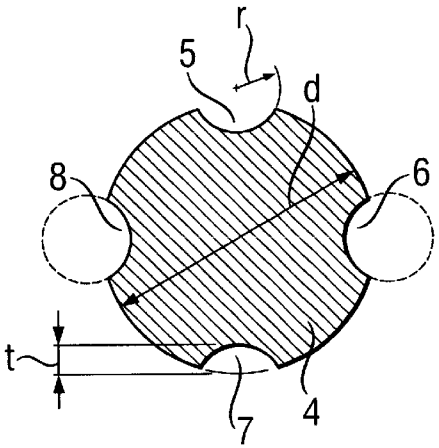
FIG. 3 is an enlarged sectional view through the insertion end, perpendicular to the tool axis.
Figure 2:
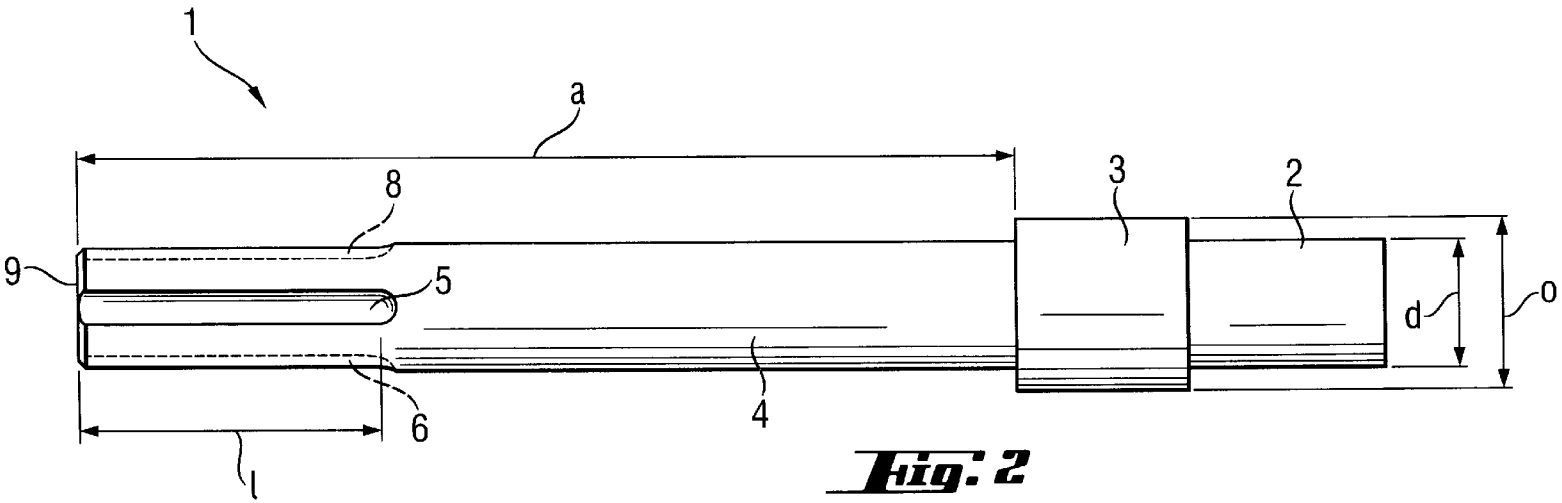
FIG. 2 is a side view of the insertion end of FIG. 1.

An example of a drilling and/or chiseling tool 1, is shown in various views and in section in FIGS. 1–3. It comprises an axial shaft 2 and an axially extending insertion end 4 adjoining the shaft. In a transition region from the shaft 2 to the insertion end 4, a revolving collar 3 is provided, which extends radially outwardly from the insertion end 4 and the shaft 2. A drilling head is disposed at the end of the shaft 2 opposite the insertion end. In the Figures, the drilling head is not shown, since it is of no further significance for the invention. The diameter d of the insertion end 4 (FIG. 2) is selected to be equal to or larger than 18 mm and preferably larger than 22 mm. For example, the diameter of the insertion end is 23 mm or 25 mm. The collar 3 has an outer diameter o, which is about 1.25 times to about 1.5 times the diameter d of the insertion end (FIG. 2). The distance a of the collar 3 from the free end 9 of the insertion end 4 is about 7 times to about 9 times the diameter d of the insertion end 4 (FIG. 2).

The insertion end 4 is provided with a number of elongated recesses 5 to 8 extending parallel to the axis, which are formed open toward the outer surface of and toward the free end 9 of the insertion end 4. In accordance with the example of the tool 1, the insertion end 4 has four elongated recesses 5 to 8, arranged at the same angular distance from one another around the circumference of the insertion end 4. The recesses 5 to 8 have an axial length 1, which corresponds approximately to 2 times to approximately 4 times the diameter d of the insertion end 4 (FIG. 2). The recesses 5 to 8 have a cross-section area, extending perpendicularly to the center axis of the tool 1, expanding towards the outer surface and formed essentially as a divided circle or arc of a circle. In this connection, the radius of curvature r of the arc-shaped recesses 5 to 8 amounts to about 0.1 times to about 0.35 times the diameter d of the insertion end 4 (FIG. 3). In FIG. 3, circles are in each case inscribed with broken lines for the two recesses 6 and 8, which lie opposite one another on a diameter, to illustrate the divided circle arrangement of the recesses. The recesses 5 to 8 have a depth t in relation to the outer surfaces, measured in the radial direction, and amounts to about 50% to about 100% of their radius of curvature r (FIG. 3).

Figure 4:
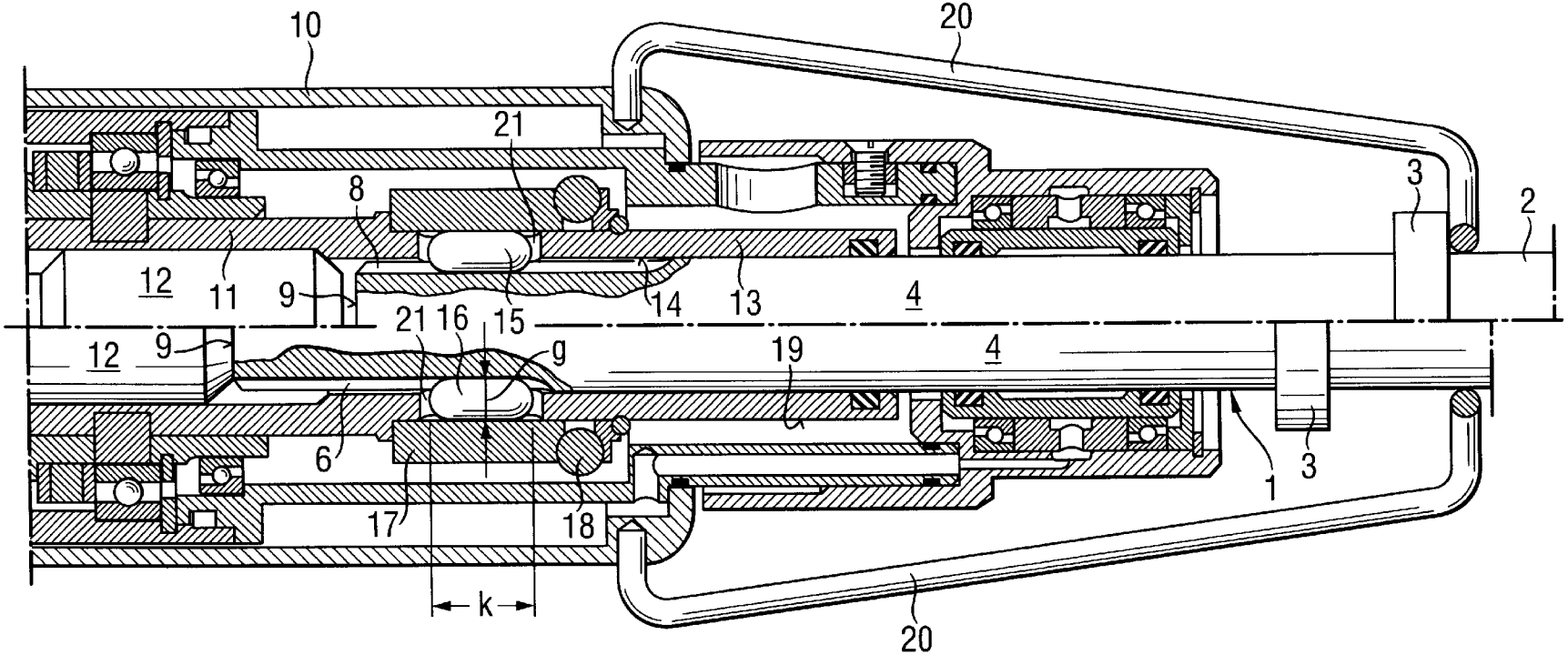
FIG. 4 is an axial section of a tool chuck of a drilling and/or chiseling device, for the inventive drilling and/or chiseling tool.

FIG. 4 shows an axial section of an example of a tool chuck or holder 13 of a drilling and/or chiseling device, matched to the inventive drilling and/or chiseling tool. The tool chuck 13 is inserted into an axially extending front section of a device housing 10. A rotating spindle 11 is disposed inside the housing 10. Also shown is an anvil element 12, which is a component of a preferably electropneumatic impact mechanism and serves to transfer axial impacts onto the rear free end 9 of the drilling and/or chiseling tool 1 inserted into the tool chuck 13. The tool chuck 13, inserted into the front section of the housing 10, is connected detachably and rotationally locked with the rotating spindle 11. Roller-shaped rotationally locking bodies 15, 16 are disposed in the tool holder 13, which are fixed axially and radially in grooves 21 of the tool holder 13. In this connection, the grooves 21 are constructed so that during operation the roller-shaped rotationally locked bodies 15, 16 can rotate about their own axis. The rotationally locked bodies 15, 16 are fixed radially by a cylindrical fixing sleeve 17, mounted on the outside 19 of the tool holder, and fixed by a clamping ring 18. The roller-shaped rotationally locking bodies 15, 16 are arranged in the grooves 21 so that they project inwardly of the inner wall 14 of the tool holder 13 by about 30% to about 47% of their largest diameter g. The radius of curvature of the roller-shaped rotationally locking bodies 15, 16 preferably corresponds to the radius of curvature of the arc-like recesses in the insertion end of the tool. The length of the roller-shaped rotationally locking bodies 15,16 is about 25% to about 70% of the axial length 1 of the elongated recesses 6, 8 in the insertion end 4 of the inventive drilling and/or chiseling tool 1. These length ratios ensure that the rotationally locking bodies 15, 16 constantly remain over their whole length in two-dimensional contact with the recesses 6, 8 in the insertion end 4 of the tool 1. To illustrate this fact, the upper half and the lower half of FIG. 4 show the drilling and/or chiseling tool 1 inserted into the tool holder 13 in two different, extreme positions. The lower half of FIG. 4 shows the tool in its starting position, in which the free end 9 of the insertion end 4 rests against the anvil element 12. In the upper half of FIG. 4, the greatest possible axial displacement of the tool 1 in the tool holder 13 is indicated. The axial displacement is limited by a shackle 20, hinged at the front section of the device housing 10, and can be pivoted in such a manner that it engages the ring-shaped collar 3 in the transition region from the shaft 2 to the insertion end 4.

FIG. 4 shows only two rotationally locking bodies 15, 16. Preferably, the number of rotationally locking bodies corresponds to the number of recesses in the insertion end of the drilling and/or chiseling tool.

What is claimed as new and desired to be protected by letters patent is set forth in the appended claims:

1. A drilling and/or chiseling tool has an axially extending shaft (2), said shaft having a cylindrical insertion end (4) with an outer axially extending surface having at least one axially elongated recess (5 to 8) open toward the outer surface of and toward a free end (9) of the insertion end (4) and forming a rotationally locking groove, and a collar (3) is disposed between the shaft (2) and the insertion end (4) and extends at least partially around the tool (1) and projects at least outwardly from the shaft (2) and the insertion end (4), said insertion end has a diameter (d) of at least 18 mm, and said recess (5 to 8) has a cross-sectional area, extending perpendicularly to the axis of said shaft (2) and expanding toward the outer surface and is formed essentially in the form of an arc of a circle and is arranged to receive similarly shaped means for transferring torque to said recess in said tool, said insertion end (4) has four recesses (5, 6, 7, 8), which are arranged at the same angular distance from one another around the circumference of said insertion end (4), and said recesses (5 to 8) each have a length (l), in the range of about 2 times to about 4 times the diameter (d) of said insertion end (4).

2. A drilling and/or chiseling tool, as set forth in claim 1, wherein said insertion end has the diameter (d) larger than 22 mm.

3. A drilling and/or chiseling tool, as set forth in claim 1, wherein said recesses (5 to 8) have a radius of curvature (r), in the range of about 0.1 times to about 0.35 times the diameter (d) of the insertion end (4).

4. A drilling and/or chiseling tool, as set forth in claim 3, wherein the recesses have a depth (t) relative to the outer surface of said insertion end (4) measured in the radial direction in the range of about 50% to about 100% of the radius of curvature (r) of the recess (5 to 8).

5. A drilling and/or chiseling tool, as set forth in claim 1, wherein said collar (3) has an outer diameter (a) in the range of about 1.25 times to about 1.5 times the diameter (d) of the insertion end (4).

6. A drilling and/or chiseling tool, as set forth in claim 1, wherein a distance (a) between the collar (3) and the free end (9) of the insertion end (4) amounts to about 7 times to about 9 times the diameter (d) of the insertion end (4).

7. A drilling and/or chiseling device for operation in connection with a drilling and/or chiseling tool of claim 1, wherein a tool chuck (13) with at least one roller-shaped rotationally locking body (15, 16) is fixed axially and radially in a groove (21) provided in an inner wall (14),of the tool chuck (13) and can be rotated about its axis and projects inwardly of the inner wall (14) of the tool chuck (13) in the range of about 30% to about 47% of its largest diameter (g).

8. A drilling and/or chiseling device, as set forth in claim 7, wherein the radius of curvature of the at least one rotationally locking body (15, 16) corresponds to the radius of curvature of the recess (5 to 8) in the insertion end (4) of the drilling and/or chiseling tool (1).

9. A drilling and/or chiseling device, as set forth in claim 7, wherein the number of rotationally locking bodies (15, 16) in the tool chuck (13) corresponds to the number of recesses (5 to 8) in the insertion end (4) of the drilling and/or chiseling tool (1).

10. A drilling and/or chiseling device, as set forth in claim 9, wherein the rotationally locking bodies are distributed uniformly around the inner periphery of the inner wall of the tool chuck.

11. A drilling and/or chiseling tool, as set forth in claim 9, wherein the tool chuck has four rotationally locking bodies and/or chiseling device, matched to the insertion end, is provided to receive the insertion end (4) of the tool (1) and fit rotationally locking bodies into the at least one elongated recess (5 to 8).

* * * * *